US006820433B2

(12) United States Patent
Hwang

(10) Patent No.: US 6,820,433 B2
(45) Date of Patent: Nov. 23, 2004

(54) ICE MAKER

(75) Inventor: Ji-Sick Hwang, Yangsan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/674,405

(22) Filed: Oct. 1, 2003

(65) Prior Publication Data

US 2004/0144100 A1 Jul. 29, 2004

(30) Foreign Application Priority Data

Jan. 24, 2003 (KR) ..... 10-2003-0004869

(51) Int. Cl.[7] ..... F25B 21/02
(52) U.S. Cl. ..... 62/3.63; 62/237
(58) Field of Search ..... 62/3.2, 3.3, 3.6, 62/3.63, 237, 437

(56) References Cited

U.S. PATENT DOCUMENTS

| | | | | |
|---|---|---|---|---|
| 2,510,400 A | | 6/1950 | Hurley | |
| 2,990,697 A | | 7/1961 | Buzicky | |
| 3,146,601 A | | 9/1964 | Gould | |
| 3,192,726 A | * | 7/1965 | Newton | 62/3.63 |
| 4,055,053 A | * | 10/1977 | Elfving et al. | 62/3.63 |
| 4,487,024 A | | 12/1984 | Fletcher et al. | |
| 5,140,831 A | | 8/1992 | Kohl et al. | |
| 5,778,677 A | * | 7/1998 | Hung et al. | 62/3.63 |
| 6,401,461 B1 | * | 6/2002 | Harrison et al. | 62/3.61 |
| 2001/0027654 A1 | | 10/2001 | Shapiro et al. | |

FOREIGN PATENT DOCUMENTS

| | | |
|---|---|---|
| DE | 1922920 | 5/1969 |
| EP | 3256665 | 3/2004 |
| JP | 200-88414 | 3/2000 |

* cited by examiner

*Primary Examiner*—Melvin Jones
(74) *Attorney, Agent, or Firm*—Staas & Halsey LLP

(57) ABSTRACT

An ice maker including a cooling and heating apparatus to absorb heat on one side of the apparatus's structure, and then distribute the heat on the opposite side of the apparatus's structure, and at least one receptacle to receive water for freezing, wherein the receptacle is mechanically inverted in order to release the ice. The receptacle is located above the heat absorbing side of the apparatus when water is being frozen, and the receptacle is located below the heat distributing side when the ice is released.

28 Claims, 2 Drawing Sheets

ICE MAKER

CROSS-REFERENCE TO RELATED APPLICATIONS

This application claims the benefit of Korean Application No. 2003-4869, filed Jan. 24, 2003, in the Korean Industrial Property Office, the disclosure of which is incorporated herein by reference.

BACKGROUND OF THE INVENTION

1. Field of the Invention

The present invention relates to an ice maker, and more particularly to an ice maker which makes ice and removes ice from the ice tray efficiently.

2. Description of the Related Art

As is generally known in the art, an ice maker is an apparatus that is mounted in a refrigerator or in a vending machine and makes ice when water is supplied.

An ice maker according to the related art consists of a driving pulley, a following pulley which is mounted near the driving pulley at a predetermined distance, and an ice-making conveyor provided with a plurality of ice making grooves. The ice-making conveyor is mounted to roll on the driving pulley and the following pulley. In addition, a heater is provided at an inner part of the ice-making conveyor so as to remove ice, which is frozen in the ice-making groove, from the ice-tray that is located at the lower part of the ice-making conveyor.

Accordingly, when ice is made in ice-making grooves which are located on the upper surface of an ice-making conveyor, the driving pulley and the following pulley make the ice-making conveyor move so as to make the ice-making grooves face downward. Then the heater is turned on that generates heat so as to remove ice from the ice-making grooves.

However, in an ice maker according to the related art, a heater that generates heat to remove ice from the ice-making grooves increases the temperature in the freezer in which the ice maker is mounted. Thus the ice-making process is not performed efficiently.

SUMMARY OF THE INVENTION

Accordingly, the present invention has been made to solve the above-mentioned problems occurring in the related art, and an object of the present invention is to provide an ice maker that makes ice more efficiently.

Additional aspects and advantages of the invention will be set forth in part in the description that follows and, in part, will be obvious from the description, or may be learned by practice of the invention.

To achieve the above and other aspects of the present invention, there is provided an ice maker according to present invention. The ice maker comprises a cooling and heating apparatus to absorb heat on one side of the apparatus's structure, and then distribute the heat on the opposite side of the apparatus's structure, and at least one receptacle to receive water for freezing, whereby the receptacle is mechanically inverted in order to release the ice. The receptacle is located above the heat absorbing side of the apparatus when water is being frozen, and the receptacle is located below the heat distributing side when the ice is released.

The cooling and heating apparatus may comprise a Peltier element which absorbs heat from the heat absorbing side and radiates heat to the heat distributing side.

Also, radiant pins may be provided on the heat absorbing side and the heat radiating side of the Peltier element so as to absorb and radiate the heat efficiently.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
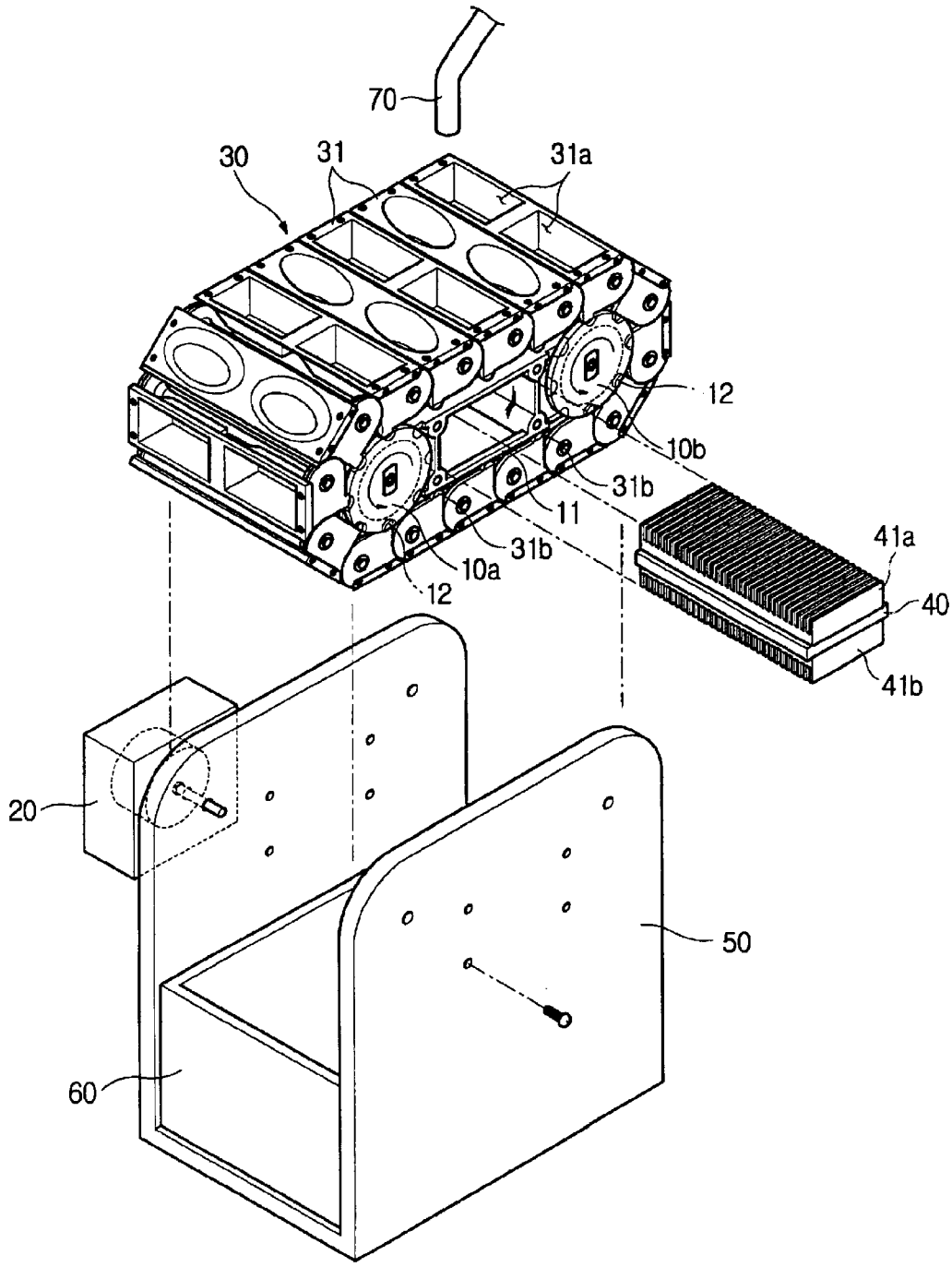
FIG. 1 shows a perspective view of an embodiment of an ice maker according to an embodiment of the present invention.

Reference will now be made in detail to an embodiment of the present invention, an example of which is illustrated in the accompanying drawings, wherein like reference numerals refer to the like elements throughout. The embodiment is described below in order to explain the present invention by referring to the figures.

Figure 2:
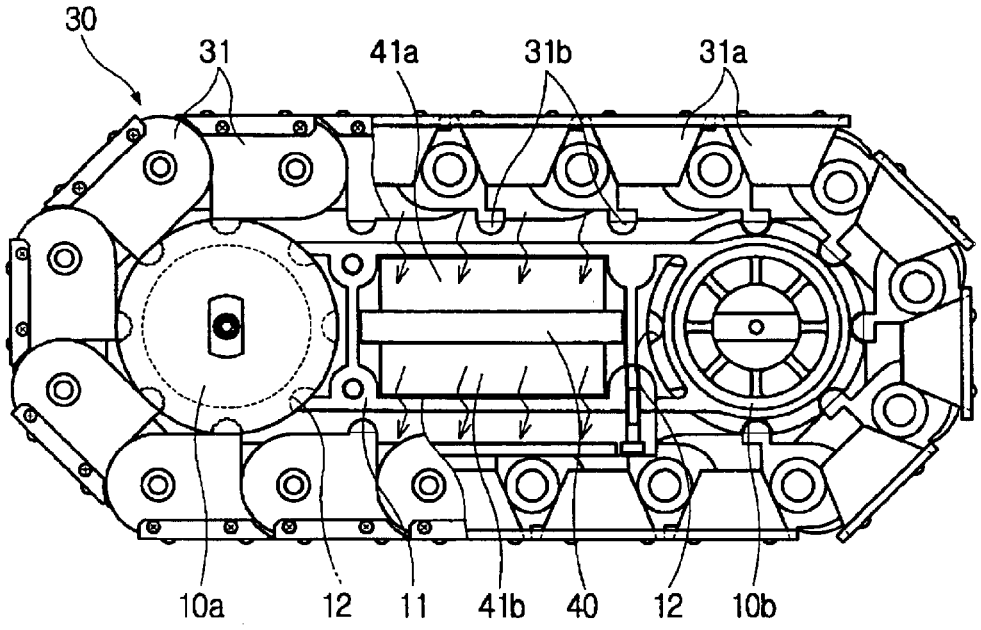
FIG. 2 shows a sectional view of the ice maker shown in FIG. 1.

As shown in FIG. 1 and FIG. 2, an ice maker according to an embodiment of the present invention comprises a pair of pulleys, 10*a* and 10*b*, which are mounted at a predetermined distance from one another, a driving apparatus 20 that rotates the pulleys 10*a* and 10*b*, and an ice-making conveyor 30 which is mounted to roll on pulleys 10*a* and 10*b*.

The pair of pulleys, 10*a* and 10*b*, are comprised of a driving pulley 10*a* and a following pulley 10*b*. The driving pulley 10*a* transfers power from the driving device 20 to rotate the ice-making conveyor 30. The following pulley 10*b* transfers power from the driving pulley 10*a* through the ice-making conveyor 30. The driving pulley 10*a* and the following pulley 10*b* are mounted at opposite ends of a supporting bracket 11, which maintains the predetermined distance between the two pulleys 10*a* and 10*b*.

The ice-making conveyor 30 is in the form of a closed curve, so that it moves in a continuous form around the pulleys 10*a* and 10*b*. A plurality of tray cells 31, at least one of which having concave ice-making grooves 31*a*, are jointly hinged to each other to make the closed curve of the ice making conveyor 30. Each ice-making groove 31*a* is made of a metallic material such as stainless steel so as to transfer heat easily.

Accordingly, each tray cell 31 has conveying projections 31*b*, which project from the inner part of the tray cell, to transfer power from the driving pulley 10*a*. A plurality of conveying grooves 12 are set on the circumference surface of the driving pulley 10*a* and following pulley 10*b* to gear with the conveying projections 31*b*. Thus, the tray cells move around the driving pulley 10*a* and the following pulley 10*b* when the power is transferred from the driving pulley 10*a* to the tray cells 31 through the conveying projections 31*b* and conveying grooves 12.

The ice maker according to this embodiment of the present invention has a cooling and heating apparatus at an inner part of the supporting bracket 11 (or ice-making conveyor 30) to separate ice from the tray cells 31.

The cooling and heating apparatus comprises a heat sink part that absorbs heat from lower part of the ice-making grooves 31*a* of tray cells 31 when they are located above the apparatus, and a radiation part that radiates the absorbed heat to the lower part of the ice-making grooves 31*a* of the tray cells 31 when they are located below the apparatus. Therefore, the cooling and heating apparatus is devised to chill tray cells located above the upper part of the apparatus, and to heat tray cells located below the lower part of the apparatus.

According to one embodiment of the present invention, a Peltier element 40 is provided as a cooling and heating apparatus. Cohesion of two different metals that forms a junction of an n-type semiconductor and a p-type semiconductor makes a Peltier element. When direct current is supplied to the Peltier element, heat absorption and heat radiation occurs at opposite surfaces of the Peltier element. Accordingly, the heat sink part of the Peltier element 40, in which heat absorption occurs, operates to chili surroundings, and the radiation part of the Peltier element 40 heats surroundings.

Accordingly, the heat sink part of the Peltier element 40 is arranged to face the upper part of the conveyor 30, and the radiation part of the Peltier element 40 is arranged to face the lower part of the conveyor 30, so as to chill the upper tray cells 31 and heat the lower tray cells 31.

In addition, the Peltier element has separate radiation pins 41*a* and 41*b* at its upper and lower parts. The upper radiation pins 41*a* are arranged to absorb heat from the upper tray cells 31 easily. The lower radiation pins 41*b* are arranged to radiate heat to the lower tray cells 31 easily.

An ice maker according to one embodiment of the present invention is mounted in a freezer by fixing both ends of the supporting bracket 11 to another structure. In this embodiment, a board-shaped fixed bracket 50 is provided to fix both ends of the supporting bracket 11 to mount the ice maker on the fixed bracket 50, as illustrated in FIG. 1.

Accordingly, a storage tray 60 is provided at the lower part of the ice maker to store ice made by ice maker. A water feed pipe 70 is provided at the upper part of the ice maker so as to supply water to the tray cells 31.

The construction and operation of an ice maker according to an embodiment of the present invention will be further described below with reference to FIGS. 1 and 2.

As the tray cells 31 face upward while moving along the conveyor 30, the ice-making grooves 31*a* are filled with water by the water feed pipe 70. Since the ice maker is mounted inside the freezer, the water is chilled constantly until made into ice in the ice-making grooves 31*a* after a predetermined time.

To use the ice after freezing, it has to be separated from the tray cells 31. The ice-making conveyor 30 is propelled by the driving device 20 and pulleys 10*a* and 10*b*, causing the tray cells 31 to invert in preparation for separating the ice from the tray cells 31. When power is supplied to the driving device 20, the driving pulley 10*a* rotates. The conveying grooves 12, which are located on circumference surface of the driving pulley 10*a*, gear with the conveying projections 31*b*, which project from the inner part of the tray cells 31. As a result, the ice-making conveyor 30 moves around the pulleys 10*a* and 10*b*, inverting the tray cells 31, temporarily leaving the ice-making grooves 31*a*, in which the ice is made, facing downward.

When power is supplied to the Peltier element 40, the Peltier element 40 absorbs heat from the upper part of its structure and radiates heat to its lower part. Thus, the tray cells 31 are chilled by the Peltier element 40 when they are located above the element, and are heated by the Peltier element 40 when they are located below it.

When the tray cells 31 are positioned on the upper part of the conveyor 30, above the Peltier element 40, water in the ice-making grooves 31*a* freezes much faster because of heat absorption of the Peltier element 40. Frozen ice in the ice-making grooves 31*a* of tray cells 31 which are located on the lower part of the conveyor 30 begins to melt due to the heat radiated from the Peltier element 40 above the tray cells 31. Ice is separated from the ice-making grooves 31*a* due to its own weight, and thusly falls into the storage tray 60.

As described above, an embodiment of the present invention provides an ice maker provided with a Peltier element, which is both a cooling and heat radiating apparatus, located at the inner part of an ice-making conveyor. The Peltier element absorbs heat from the tray cells which are located at the upper part of the conveyor, thereby allowing ice to be made more easily in the upper tray cells. The Peltier element also radiates absorbed heat to tray cells at the lower part of the conveyor, thereby allowing the ice to be more easily separated from the lower tray cells. Thus, a Peltier element improves the efficiency of the making of the ice, as well as the separation of the ice from the tray cells. The refrigerator having an ice maker of this invention thus has an improved operational reliability and improved market competitiveness.

Although one embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An ice maker comprising:

a cooling and heating apparatus to absorb heat on one side of the apparatus's structure, and then distribute the heat on the opposite side of apparatus's structure, wherein the cooling and heating apparatus is in a stationary position;

at least one receptacle to receive water for freezing, wherein the receptacle rotates relative to the cooling and heating apparatus;

wherein the receptacle is located above the heat absorbing side of the apparatus when water is being frozen; and wherein the receptacle is located below the heat distributing side when the ice is released.

2. The ice maker according to claim 1, wherein the cooling and heating apparatus comprises a Peltier element which absorbs heat from the heat absorbing side and radiates heat to the heat distributing side.

3. The ice maker according to claim 1, wherein the receptacle is joined to one or more other like receptacles to form a conveyor.

4. The ice maker according to claim 3, further comprising a driving device;

wherein the driving device propels the conveyor.

5. The ice maker according to claim 4, further comprising at least one driving pulley;

wherein the driving device is coupled to the at least one driving pulley that propels the conveyor.

6. The ice maker according to claim 5, wherein the driving pulley is provided with portions making interlocking connections with the receptacles.

7. The ice maker according to claim 1, wherein the receptacle is made of metallic material so as to absorb and radiate heat easily.

8. The ice maker according to claim 7, wherein the metallic material is stainless steel.

9. The ice maker according to claim 1, further comprising a water feed pipe; wherein the water is delivered to the receptacle by the water feed pipe.

10. An ice maker comprising a cooling and heating apparatus having a Peltier element to absorb heat on one side of the apparatus's structure, and then distribute the heat on the opposite side of the apparatus's structure;

at least one receptacle to receive water for freezing, wherein the receptacle is mechanically inverted to release ice;

radiant pins which are provided on the heat absorbing side and the heat radiating side of the Peltier element so as to absorb and radiate the heat efficiently;

wherein the receptacle is located above the heat absorbing side of the apparatus when water is being frozen; and wherein the receptacle is located below the heat distributing side when the ice is released.

11. An ice maker comprising:

a cooling and heating apparatus to absorb heat on one side of the apparatus's structure, and then distribute the heat on the opposite side of the apparatus's structure;

receptacles joined to one another to form a conveyor and to receive water for freezing, wherein the receptacles are mechanically inverted to release the ice, and the receptacles are located above the heating absorbing side of the apparatus when water is being frozen, and located below the heating distributing side when the ice is released;

a driving device and at least one driving pulley, wherein the driving device is coupled to the at least one driving pulley to propel the conveyor;

wherein the driving pulley and the receptacles are provided with portions to make interlocking connections with each other.

12. The ice maker according to claim 11, further comprising at least one following pulley;

wherein the conveyor is also coupled to the at least one following pulley which provides support for the conveyor.

13. The ice maker according to claim 12, further comprising a supporting bracket; wherein the driving pulley and following pulley are separated at a predetermined distance by the supporting bracket.

14. The ice maker according to claim 13, wherein the cooling and heating apparatus is disposed within the supporting bracket.

15. A method for making ice in an ice maker, the method comprising:

placing at least one receptacle that receives water for freezing over a cooling and heating apparatus, the apparatus absorbing heat on one side of the apparatus's structure and then distributing the heat on the opposite side of the apparatus's structure, wherein the apparatus absorbs heat from the receptacle to assist in making the ice; and inverting and placing the receptacle under the apparatus, wherein the apparatus radiates heat to help remove the ice from the receptacle.

16. The method according to claim 15, wherein the cooling and heating apparatus is equipped with a Peltier element which absorbs heat from the heat absorbing side and radiates heat to the heat distributing side.

17. The method according to claim 16, wherein radiant pins are provided on the upper part and the lower part of the Peltier element so as to absorb and radiate heat efficiently.

18. The method according to claim 15, wherein the receptacle is joined to one or more other like receptacles to form a conveyor.

19. The method according to claim 18, wherein the conveyor is equipped with a driving device that propels the conveyor.

20. The method according to claim 19, wherein the driving device is coupled to at least one driving pulley that propels the conveyor.

21. The method according to claim 20, wherein the driving pulley is provided with portions making interlocking connections with the receptacles.

22. The method according to claim 21, wherein the receptacles are provided with portions making interlocking connections with the driving pulley.

23. The method according to claim 22, wherein the conveyor is also coupled to at least one following pulley which provides support for the conveyor.

24. The method according to claim 23, wherein the driving pulley and following pulley are separated at a predetermined distance by a supporting bracket.

25. The method according to claim 24, wherein the cooling and heating apparatus is disposed within the supporting bracket.

26. The method according to claim 15, wherein the receptacle is made of metallic material so as to absorb and radiate heat easily.

27. The method according to claim 26, wherein the metallic material is stainless steel.

28. The method according to claim 15, wherein the water is delivered to the receptacle by a water feed pipe.

* * * * *

UNITED STATES PATENT AND TRADEMARK OFFICE

CERTIFICATE OF CORRECTION

PATENT NO. : 6,820,433 B2
DATED : November 23, 2004
INVENTOR(S) : Ji-Sick Hwang

It is certified that error appears in the above-identified patent and that said Letters Patent is hereby corrected as shown below:

Column 5,
Line 1, after "comprising" insert -- : --.

Signed and Sealed this

Tenth Day of May, 2005

JON W. DUDAS
*Director of the United States Patent and Trademark Office*